US006764241B1

(12) United States Patent
Tower

(10) Patent No.: US 6,764,241 B1
(45) Date of Patent: Jul. 20, 2004

(54) SUPPORT SURFACE MOUNTED SEQUENTIAL FIRST PAGE NOTEBOOK

(76) Inventor: Robert P. Tower, 281 Lake Dr., Coconut Creek, FL (US) 33066

( * ) Notice: Subject to any disclaimer, the term of this patent is extended or adjusted under 35 U.S.C. 154(b) by 0 days.

(21) Appl. No.: 10/114,736

(22) Filed: Apr. 2, 2002

(51) Int. Cl.[7] ..... B42F 3/02

(52) U.S. Cl. ..... 402/20; 40/107; 116/234; 248/441.1; 281/21.1; 281/45; 402/57

(58) Field of Search ..... 40/119, 107; 116/234; 248/441.1, 454; 281/15.1, 16, 21.1, 43, 44, 45, 46; 402/4, 8, 57, 70, 73, 77, 79, 80 L

(56) References Cited

U.S. PATENT DOCUMENTS

| | | | | | |
|---|---|---|---|---|---|
| 703,260 | A | | 6/1902 | Holton | |
| 808,652 | A | | 1/1906 | Hackmann et al. | |
| 1,720,607 | A | * | 7/1929 | Reed | 248/452 |
| 1,916,730 | A | * | 7/1933 | Kemp | 281/45 |
| 2,061,492 | A | * | 11/1936 | Tolman | 40/119 |
| 2,194,023 | A | * | 3/1940 | Kranhold | 40/119 |
| 2,526,090 | A | * | 10/1950 | Slonneger et al. | 462/22 |
| 2,542,290 | A | * | 2/1951 | Rochford | 248/452 |
| 2,789,836 | A | * | 4/1957 | Jeannin | 281/45 |
| 3,108,823 | A | | 10/1963 | Thaw | 281/25 |
| 4,239,410 | A | | 12/1980 | Pianta | 402/20 |
| 4,484,830 | A | * | 11/1984 | Anderson | 402/77 |
| 4,867,594 | A | * | 9/1989 | Poulouin | 402/70 |
| 5,503,486 | A | | 4/1996 | Zane | 402/72 |
| 6,210,065 | B1 | * | 4/2001 | Tower | 402/57 |

* cited by examiner

*Primary Examiner*—Monica S. Carter
(74) *Attorney, Agent, or Firm*—Oltman, Flynn & Kubler

(57) ABSTRACT

A notebook includes a support structure in the form of a plastic pad case having a support surface in the form of a pad case back wall; a number of pages each having a page binder edge and a page free edge and a page length from the page binder edge to the page free edge, and having at least two page binder holes adjacent to the page binder edge, the pages being stacked sequentially face to face to form a pad so that corresponding page binder holes register with each other; a binder passing through registering the page binder holes and binder axial passageway; a mounting shaft extending through the binder axial passageway; and at least one shaft mounting and spacing structure connected to the mounting shaft and connected to the support surface and spacing the mounting shaft outwardly from the support surface a distance less than the page length and positioning the mounting shaft to be substantially parallel with the support surface, and thereby defining between the mounting shaft and the support surface a page passing slot.

8 Claims, 3 Drawing Sheets

SUPPORT SURFACE MOUNTED SEQUENTIAL FIRST PAGE NOTEBOOK

BACKGROUND OF THE INVENTION

1. Field of the Invention

The present invention relates to the field of stationery, books, office and school products generally. More specifically the present invention relates to a notebook having a plurality of pages forming a pad and bound together at a page binder edge by a ring or spiral binder, and with a binder mounting shaft secured substantially parallel with and spaced outwardly from the support surface by shaft mounting structures. The shaft mounting structures preferably are legs of U-shaped wire and the mounting shaft is the wire segment interconnecting the legs. The notebook is constructed to permit the sequential passage of the forwardmost, or first page through the space between the shaft and support surface to become the last page in the pad. The rotated page becomes the last page in the pad, rather than merely a folded back first page. First page rotation exposes and causes the second page to become the first page, which then may be rotated to the back of the pad to expose and cause the next page to become the first page. This page rotation may be performed indefinitely.

2. Description of the Prior Art

There have long been notebooks including note pads for containing a series of bound pages and arranged so that each page can be folded behind the pad after use. A problem with these prior pads has been that the cover must be folded behind the pad, and then pages folded behind the cover, so that pages rotated behind the pad are obstructed by the cover or other notebook parts from rejoining the pad. Then, to close the notebook so that the cover is exposed outside the pad, the used pages must be folded back on top of unused pages. Where the pad is mounted on a support surface, the support surface itself obstructs and prevents rotation of the pad first page to become the pad last page. As a result, when the user wishes to begin writing on the next available page, he or she must flip past all the used pages to reach it.

Holton, U.S. Pat. No. 703,260, issued on Jun. 24, 1902, discloses a tablet including a stack of writing sheets and a one piece binder in the form of two spaced apart binder rings interconnected by a connecting rod. The rings have flat back portions to rest on a table and curved front portions around which the sheets are rotated after use. The sheets cannot rotate all the way around the rings to reach the back of the stack, however, because the ring connecting rod would stop them.

Hackmann, et al., U.S. Pat. No. 808,652, issued on Jan. 2, 1906, teaches a note book having a binder similar to that of Holton. Two circular binder rings are interconnected by a straight rod portion, which would prevent full sheet rotation just as in Holton. Thaw, U.S. Pat. No. 3,108,823, issued on Oct. 29, 1963 for a paper securement device, includes binder rings mounted onto a backboard which can be opened to load and reload paper. Pianta, U.S. Pat. No. 4,239,410, issued on Dec. 16, 1980 reveals a stationary booklet having cardboard covers and a refillable binder made up of tubular rings passing through slots in the cover and sheets, which can be split longitudinally and reconnected. Zane, U.S. Pat. No. 5,503,486, issued on Apr. 2, 1996, discloses a notebook and notebook cover assembly. None of these devices appear to permit the full rotation of sheets from the front to the back of a pad.

It is thus an object of the present invention to provide a surface mounted notebook including a pad of writing pages which permits sequential rotation of the forward most page past the mounting surface to the back of the pad, to become the last page in the pad, so that the next page to be used is always the first page in the notebook.

It is another object of the present invention to provide such a surface mounted notebook in which the support surface may be a backboard, a protective notebook retaining box, a building wall, a counter top, an appliance housing, or virtually any other convenient surface.

It is still another object of the present invention to provide a surface mounted notebook which may include an existing conventional spiral or ring bound notebook.

It is finally an object of the present invention to provide such a surface mounted notebook which is simple in design and inexpensive to manufacture.

SUMMARY OF THE INVENTION

The present invention accomplishes the above-stated objectives, as well as others, as may be determined by a fair reading and interpretation of the entire specification.

A notebook is provided including a support structure having a support surface; a number of pages each having a page binder edge and a page free edge and a page length from the page binder edge to the page free edge, and having at least two page binder holes adjacent to the page binder edge, the pages being stacked sequentially face to face to form a pad so that corresponding page binder holes register with each other; a binder passing through registering the page binder holes and binder axial passageway; a mounting shaft extending through the binder axial passageway; and at least one shaft mounting and spacing structure connected to the mounting shaft and connected to the support surface and spacing the mounting shaft outwardly from the support surface a distance less than the page length and positioning the mounting shaft to be substantially parallel with the support surface, and thereby defining between the mounting shaft and the support surface a page passing slot; so that the page free edge of each forward most page in the pad can be arched over the remainder of the forward most page, fitted into and rotated about the binder entirely through the page passing slot and placed against the back most page of the pad.

The support surface may be a forward surface of a substantially rigid backboard. The support surface alternatively is a box back wall of a containment box including at least two box side walls connected to and extending forwardly from the box back wall and including a box front wall which is detachable from at least one of the box side walls to open the containment box and provide access to the pages. The support surface may be a box back wall of a containment box including at least two box side walls connected to and extending forwardly from the box back wall and including a box front wall which is detachable from at least one of the box side walls to open the containment box and provide access to the pages, where the shaft mounting and spacing structure includes at least one box side wall to which the mounting shaft is secured and from which the mounting shaft extends forwardly of the box back wall a certain distance.

The box front wall preferably includes a front wall peripheral flange which fits around the box side wall. The box front wall optionally pivots from a box hinge structure connecting the box front wall to the box side wall. The shaft mounting structure preferably includes two wire legs of a U-shaped wire and the mounting shaft is a segment of the U-shaped wire interconnecting the wire legs. The binder is optionally a spiral wire threaded through the registering page holes to hold the pages and the cover together while permitting page rotation. The binder alternatively includes a series of ring-shaped wires each fitted through one registering series of the page holes to hold the pages together and permit page rotation.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
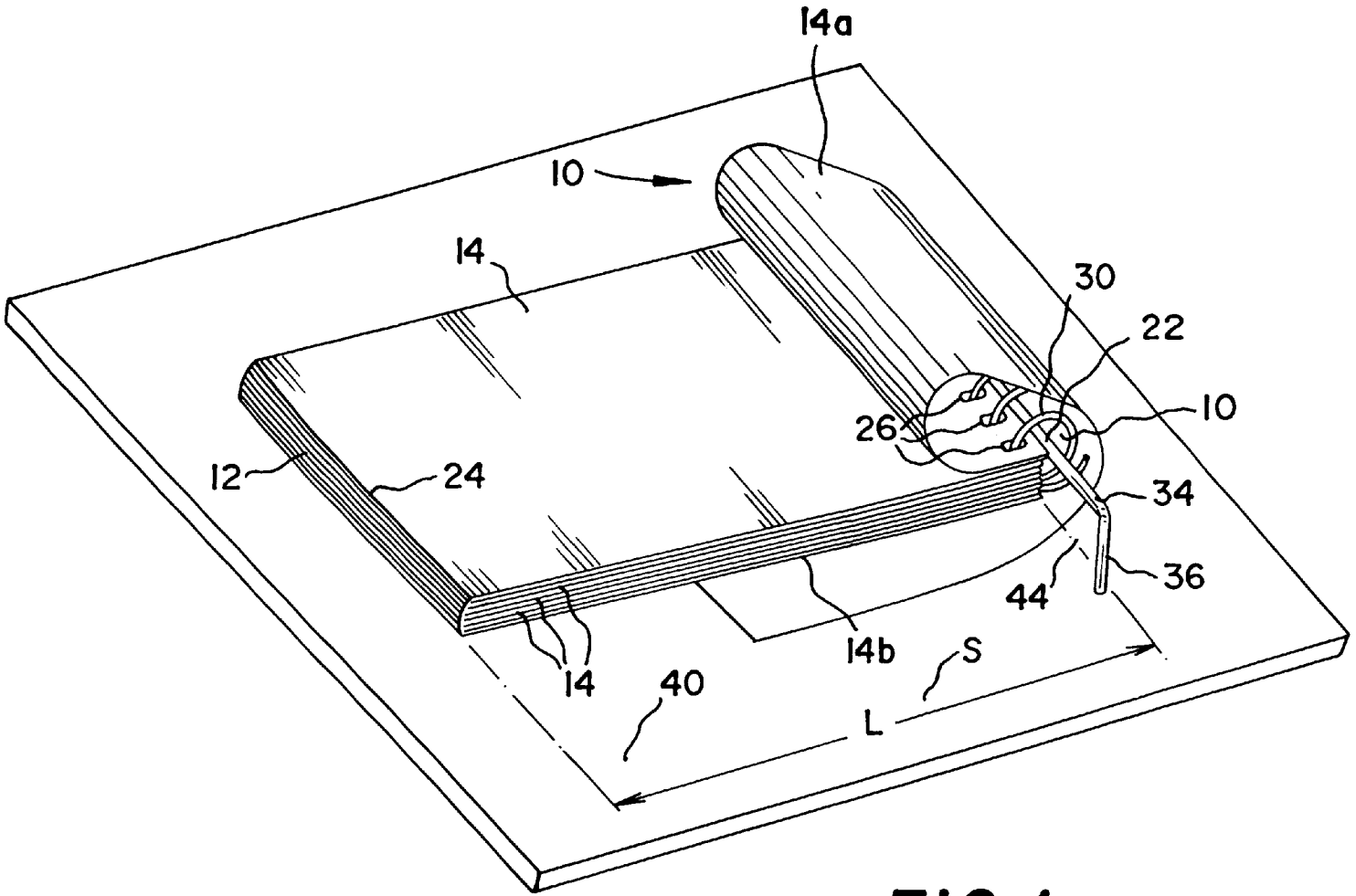
FIG. 1 is a perspective view of the notebook of the first preferred embodiment showing a pad formed of a number of pages with a spiral binder passing through page holes, the U-shaped wire defining the mounting shaft and mounting and spacing structures and the backboard support surface.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Figure 2:
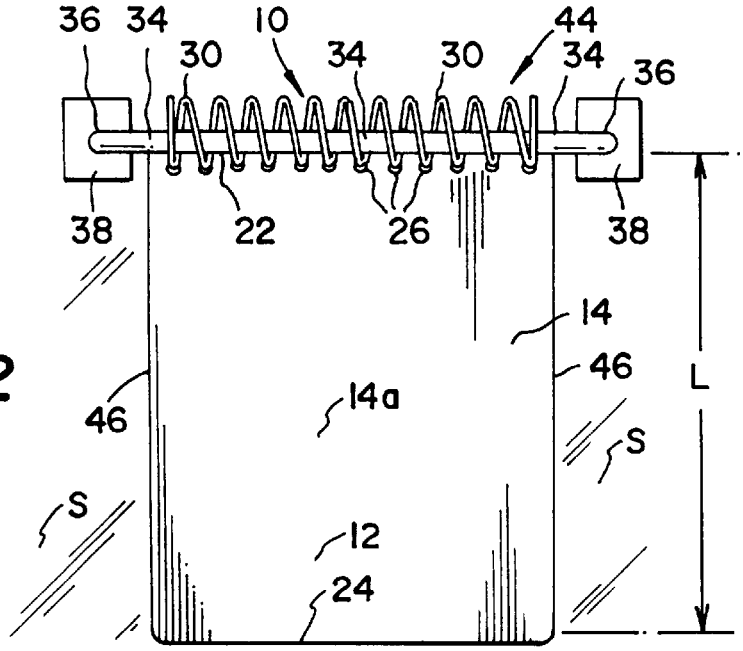
FIG. 2 is a front view of a variation of the notebook of the first preferred embodiment, showing the mounting plates anchoring the mounting and spacing structures.
Figure 3:
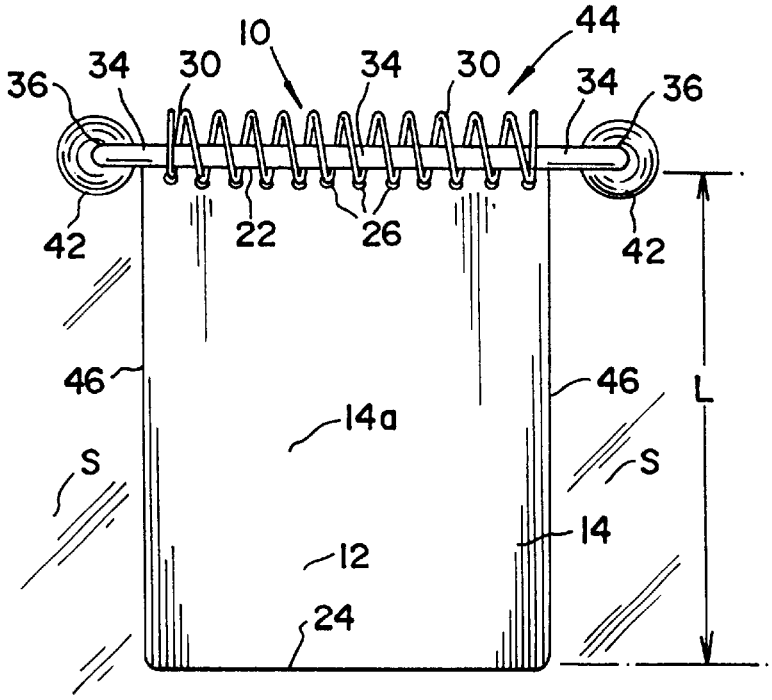
FIG. 3 is a front view of another variation of the notebook of the first preferred embodiment, showing the suction cups anchoring the mounting and spacing structures.

Referring to FIGS. 1–3, a notebook 10 is disclosed having a pad 12 including a number of pages 14, including a first page 14*a* and a last page 14*b*, each page 14 having a page binder edge 22 and a page free edge 24 and a page length L from the page binder edge 22 to the page free edge 24, and having at least two page binder holes 26 adjacent to the page binder edge 22, the pages 14 being stacked sequentially face to face to form a pad 12 so that corresponding page binder holes 26 register with each other, a binder 30 having a binder axial passageway P and binder 30 passing through registering page binder holes 26, and a mounting shaft 34 and shaft mounting and spacing structures 36 for mounting the shaft 34 to a support surface S such as a backboard 40 with magnetic back or a building wall (not shown) so that the mounting shaft 34 is spaced outwardly from the support surface S. Shaft mounting and spacing structures 36 connect mounting shaft 34 to the support surface S and space the mounting shaft 34 outwardly from the support surfaces a distance significantly less than the page length L and position the mounting shaft 34 to be substantially parallel with the support surface S, and thereby define between the mounting shaft 34 and the support surface S a page passing slot 44. It is preferred that one of the mounting and spacing structures 36 be detachable from the mounting shaft 34 so that a pad 12 and its binder 30 can easily be removed from the shaft 34 and either turned over to use the backs of pages 14 or replaced with an unused pad 12. The binder 30 may be a tubular binder, or a ring twin loop binder or a spiral wire binder. The word "notebook" as used in this application is understood to include, but not be limited to, bound pages which are either blank or are pre-printed with lines, grids, text, forms, images including drawings, and any combination of these.

Shaft mounting and spacing structures 36 preferably are wire legs of a heavy, U-shaped wire and the mounting shaft 34 is the wire segment interconnecting the legs. See FIGS. 1–3. The mounting and spacing structures 36 may connected to the support surface S by extending into the surface S, as shown in FIG. 1, or may be connected to mounting plates 38 which are secured to the support surface S by an adhesive, as shown in FIG. 2, or the mounting structures 36 may be connected to suction cups 42 which releasibly grip the support surface S with friction and a pressure differential, as shown in FIG. 3.

Second Preferred Embodiment

Figure 4:
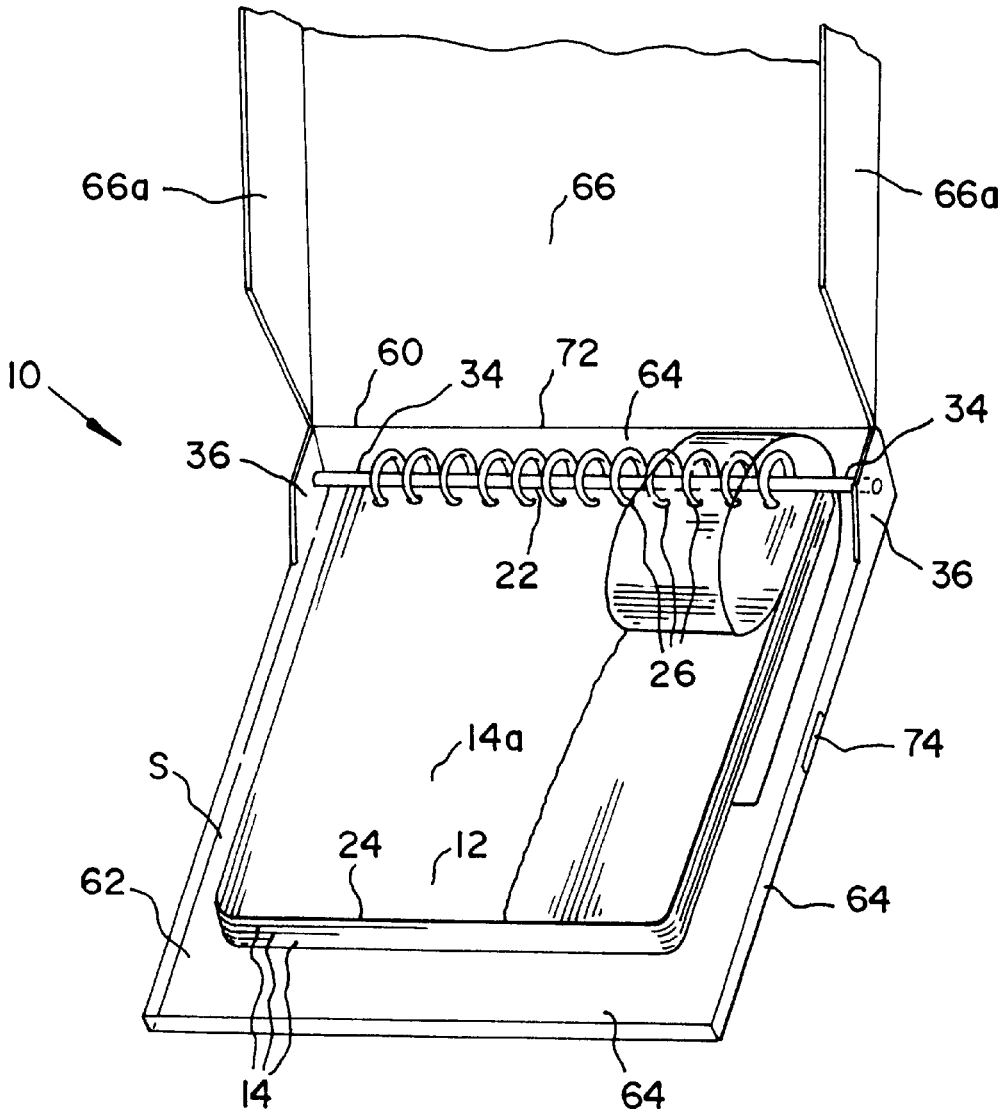
FIG. 4 is a perspective view of the second preferred embodiment including the pad containment box with a portion of the box front wall broken away.

A second embodiment of the notebook 10 is like the first except that the support surface S is a wall of a shallow notebook containment box 60. See FIG. 4. A pad case in the form of a containment box 60 has a box back wall 62, three or four box side walls 64 integral with and extending forwardly from the box back wall 62 and a box front wall 66 which opens to give access to pages 14. The box front wall 66 preferably has a front wall peripheral flange 66*a* which fits closely and optionally sealingly around the box side walls 64, and optionally pivots from a box hinge structure 72 connecting the box front wall 66 to a box side wall 64 forward edge. The containment box 60 preferably is made of a suitable and optionally transparent plastic and the box hinge structure 72 preferably is a flexible plastic segment interconnecting and integral with the given box side wall 64 and the box front wall 66. Interlocking parts of any suitable conventional snap locking box latch structure 74 preferably are provided on the box front wall 66 and on the box side wall 64 opposing the box side wall 64 connected to box hinge structure 72.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A notebook, comprising:

a support structure having a support surface;

a plurality of pages each having a page binder edge and a page free edge and a page length from said page binder edge to said page free edge, and having at least two page binder holes adjacent to said page binder edge, said pages being stacked sequentially face to face to form a pad such that corresponding said page binder holes register with each other, a binder passing through registering said page binder holes and having a binder axial passageway;

a mounting shaft extending through said binder axial passageway;

and at least one shaft mounting and spacing structure connected to said mounting shaft and connected to said support surface and spacing said mounting shaft outwardly from said support surface a distance less than said page length and positioning said mounting shaft to be substantially parallel with said support surface and thereby defining between said mounting shaft and said support surface a page passing slot;

such that the page free edge of each forward most page in said pad can be arched over the remainder of said forward most page, fitted into and rotated about said binder entirely through said page passing slot and placed against the back most page of said pad;

said support surface being a box back wall of a containment box comprising at least two box side walls connected to and extending forwardly from said box back wall and comprising a box front wall which is detachable from at least one of said box side walls to open said containment box and provide access to said pages.

2. A notebook according to claim 1, wherein said box front wall comprises a front wall peripheral flange which fits around said box side wall.

3. A notebook according to claim 1, wherein said box front wall pivots from box hinge structure connecting said box front wall to said box side wall.

4. A notebook according to claim 1, wherein said at least one mounting and spacing structure fixedly positions said mounting shaft with respect to said support structure.

5. A notebook, comprising:

a support structure having a support surface;

a plurality of pages each having a page binder edge and a page free edge and a page length from said page binder edge to said page free edge, and having at least two page binder holes adjacent to said page binder edge, said pages being stacked sequentially face to face to form a pad such that corresponding said page binder holes register with each other;

a binder passing through registering said page binder holes and having a binder axial passageway;

a mounting shaft extending through said binder axial passageway;

and at least one shaft mounting and spacing structure connected to said mounting shaft and connected to said support surface and spacing said mounting shaft outwardly from said support surface a distance less than said page length and positioning said mounting shaft to be substantially parallel with said support surface, and thereby defining between said mounting shaft and said support surface a page passing slot;

such that the page free edge of each forward most page in said pad can be arched over the remainder of said forward most page, fitted into and rotated about said binder entirely through said page passing slot and placed against the back most page of said pad;

said support surface being a box back wall of a containment box comprising at least two box side walls connected to and extending forwardly from said box back wall and comprising a box front wall which is detachable from at least one of said box side walls to open said containment box and provide access to said pages, said shaft mounting and spacing structure comprising at least one said box side wall to which said mounting shaft is secured and from which said mounting shaft extends forwardly of said box back wall a certain distance.

6. A notebook according to claim 5, wherein said box front wall comprises a front wall peripheral flange which fits around said box side wall.

7. A notebook according to claim 5, wherein said box front wall pivots from a box hinge structure connecting said box front wall to said box side wall.

8. A notebook, comprising:

a support structure having a support surface;

a plurality of pages each having a page binder edge and a page free edge and a page length from said page binder edge to said page free edge, and having at least two page binder holes adjacent to said page binder edge, said pages being stacked sequentially face to face to form a pad such that corresponding said page binder holes register with each other;

a binder passing through registering said page binder holes and having a binder axial passageway;

a mounting shaft extending through said binder axial passageway;

and at least one shaft mounting and spacing structure connected to said mounting shaft and connected to said support surface and spacing said mounting shaft outwardly from said support surface a distance less than one quarter of said page length and positioning said mounting shaft to be substantially parallel with said support surface, and thereby defining between said mounting shaft and said support surface a page passing slot;

such that the page free edge of each forward most page in said pad can be arched over the remainder of said forward most page, fitted into and rotated about said binder entirely through said page passing slot and placed against the back most page of said pad;

said support surface being a box back wall of a containment box comprising at least two box side walls connected to and extending forwardly from said box back wall and comprising a box front wall which is detachable from at least one of said box side walls to open said containment box and provide access to said pages.

* * * * *